US005984640A

United States Patent [19]

Wang

[11] Patent Number: 5,984,640

[45] Date of Patent: Nov. 16, 1999

[54] SUSPENSION ASSEMBLIES FOR CEILING FANS

[75] Inventor: Yuh-Shyong Wang, Taichung Hsien, Taiwan

[73] Assignee: Sen-Kun Hsu, Taichung Hsien, Taiwan

[21] Appl. No.: 09/002,692

[22] Filed: Jan. 5, 1998

[51] Int. Cl.[6] ..... F01D 25/00

[52] U.S. Cl. ..... 416/244 R; 416/5; 416/246; 248/343; 417/423.14; 417/424.1

[58] Field of Search ..... 416/5, 244 R, 416/246; 248/343; 417/423.14, 424.1

[56] References Cited

U.S. PATENT DOCUMENTS 4,634,345 1/1987 Stanek et al. ..... 416/244 R
4,729,725 3/1988 Markwardt ..... 417/423 R
5,562,421 10/1996 Huang ..... 416/244 R
5,613,832 3/1997 Su ..... 416/244 R
5,725,190 3/1998 Cuthbertson et al. ..... 248/343
5,851,107 12/1998 Wang ..... 416/244 R

*Primary Examiner*—Edward K. Look
*Assistant Examiner*—Matthew T. Shanley
*Attorney, Agent, or Firm*—Charles E. Baxley, Esq.

[57] ABSTRACT

A suspension assembly includes an upper suspension subassembly with an upper end secured to a ceiling, a connecting device including an upper end having a spherical surface engagement relationship with a lower end of the upper suspension subassembly, and a lower suspension subassembly including an upper end having a spherical surface engagement relationship with a lower end of the connecting device and a lower end securely attached to a motor for driving a ceiling fan.

12 Claims, 9 Drawing Sheets

SUSPENSION ASSEMBLIES FOR CEILING FANS

BACKGROUND OF THE INVENTION

1. Field of the Invention

The present invention relates to improved suspension assemblies for ceiling fans.

2. Description of the Related Art

Conventional suspension rods cannot effectively absorb shocks of ceiling fans. U.S. patent application Ser. No. 08,885,264, filed on Jun. 30, 1997, discloses suspension assemblies to overcome this problem. The present invention is intended to provide different designs in this regard.

SUMMARY OF THE INVENTION

In accordance with the present invention, a suspension assembly for ceiling fans comprises an upper suspension subassembly including an upper end secured to a ceiling, a connecting means comprising an upper end having a spherical surface engagement relationship with a lower end of the upper suspension subassembly, and a lower suspension subassembly including an upper end having a spherical surface engagement relationship with a lower end of the connecting means and a lower end securely attached to a motor for driving a ceiling fan.

In accordance with one aspect of the present invention, a suspension assembly comprises:

an upper supporting member securely attached to a ceiling, the upper supporting member including a first spherical surface portion, an upper suspension means securely connected to the upper supporting member and having a second spherical surface portion for engaging with the first spherical surface portion, an upper connecting means having an upper end securely connected to the upper suspension means and a lower end with a third spherical surface portion, a lower suspension means including a lower suspension member with a fourth spherical surface portion for securely engaging with the third spherical surface portion of the upper connecting means and a lower suspension tube extending downwardly from the lower suspension member, and a lower connecting means including an upper portion extended through the lower suspension tube and secured to the lower suspension member and a lower portion securely attached to a motor for driving a ceiling fan.

In a preferred embodiment of the invention, the upper supporting member includes a bowl-shaped retaining seat having a spherical inner periphery defining the first spherical surface portion and a through hole extending along a longitudinal axis thereof. The upper suspension means is bowl-shaped and includes a spherical outer surface defining the second spherical surface portion to be fittingly, securely received in the retaining seat. The spherical inner periphery of the retaining seat includes a protrusion formed thereon, and the spherical outer surface of the upper suspension means includes a notch defined therein for securely receiving the protrusion.

The upper suspension means further includes a frame wall having a central through hole defined therein and a transverse radial hole defined therein. The upper connecting means includes a ring base, an upper connecting rod and a supporting means formed between the ring base and the upper connecting rod. The upper connecting rod includes a hole defined therein and is partially received in the central through hole of the frame wall. A pin is extended through the transverse radial hole and the hole in the upper connecting rod.

Preferably, the frame wall further includes a screw hole defined in an outer periphery thereof, and a screw is extended through the screw hole to frictionally engage with an outer periphery of the upper connecting rod.

The lower suspension member further includes a frame wall having a central through hole defined therein and a transverse radial hole defined therein, and the upper end of the lower connecting means includes a hole defined therein and is received in the central through hole of the frame wall. A pin is extended through the transverse radial hole and the hole in the lower connecting means.

The frame wall further includes a screw hole defined in an outer periphery thereof, and a screw is extended through the screw hole to frictionally engage with an outer periphery of the upper portion of the lower connecting means.

The ring base of the upper connecting means includes a spherical inner periphery defining the third spherical surface portion, a second protrusion is formed on the spherical inner periphery of the ring base. The lower suspension member is bowl-shaped and includes a spherical outer periphery defining the fourth spherical surface portion. A second notch is defined in the spherical outer surface of the lower suspension member for receiving the second protrusion.

In another embodiment of the invention, the upper connecting means includes a ring base, an upper connecting face, a supporting means formed between the upper connecting face and the ring base, and an upper cover mounted to the upper connecting face.

In accordance with another aspect of the invention, a suspension assembly for ceiling fans comprises:

an upper supporting member securely attached to a ceiling, a tube extending downwardly from the upper supporting member, an upper suspension means including an inverted bowl-shaped member having an outer spherical surface defining a first spherical surface portion and a rod extending upwardly from the inverted bowl-shaped member and secured to the tube, an upper connecting means including an upper suspension seat and a lower suspension seat, the upper suspension seat including a first ring having an inner periphery defining a second spherical surface portion, the upper suspension seat further including a pair of diametrically disposed L-shaped first wings extending downwardly and outwardly from the first ring, each said first wing having a horizontal section, and the lower suspension seat including a second ring having an inner periphery defining a third spherical surface portion and a pair of diametrically disposed L-shaped second wings extending upwardly and outwardly from the second ring, each said second wing having a horizontal section with a receiving compartment defined therein for securely receiving the horizontal section of an associated said first wing, a lower suspension means including a lower suspension member with a fourth spherical surface portion for securely engaging with the third spherical surface portion and a lower suspension tube extending downwardly from the lower suspension member, and a lower connecting means including an upper portion extended through the lower suspension tube and secured to the lower suspension member and a lower portion adapted to be securely attached to a motor for driving a ceiling fan.

Preferably, the second ring of the lower suspension seat includes a protrusion formed on an inner periphery thereof, and the fourth spherical surface portion of the lower suspension member includes a notch defined therein for securely receiving the protrusion.

The inverted bowl-shaped member includes a notch defined in an outer periphery thereof, and a protrusion is formed on the inner periphery of the first ring for engaging with the notch of the inverted bowl-shaped member.

Other objects, advantages, and novel features of the invention will become more apparent from the following detailed description when taken in conjunction with the accompanying drawings.

DESCRIPTION OF THE PREFERRED EMBODIMENTS

Figure 1:
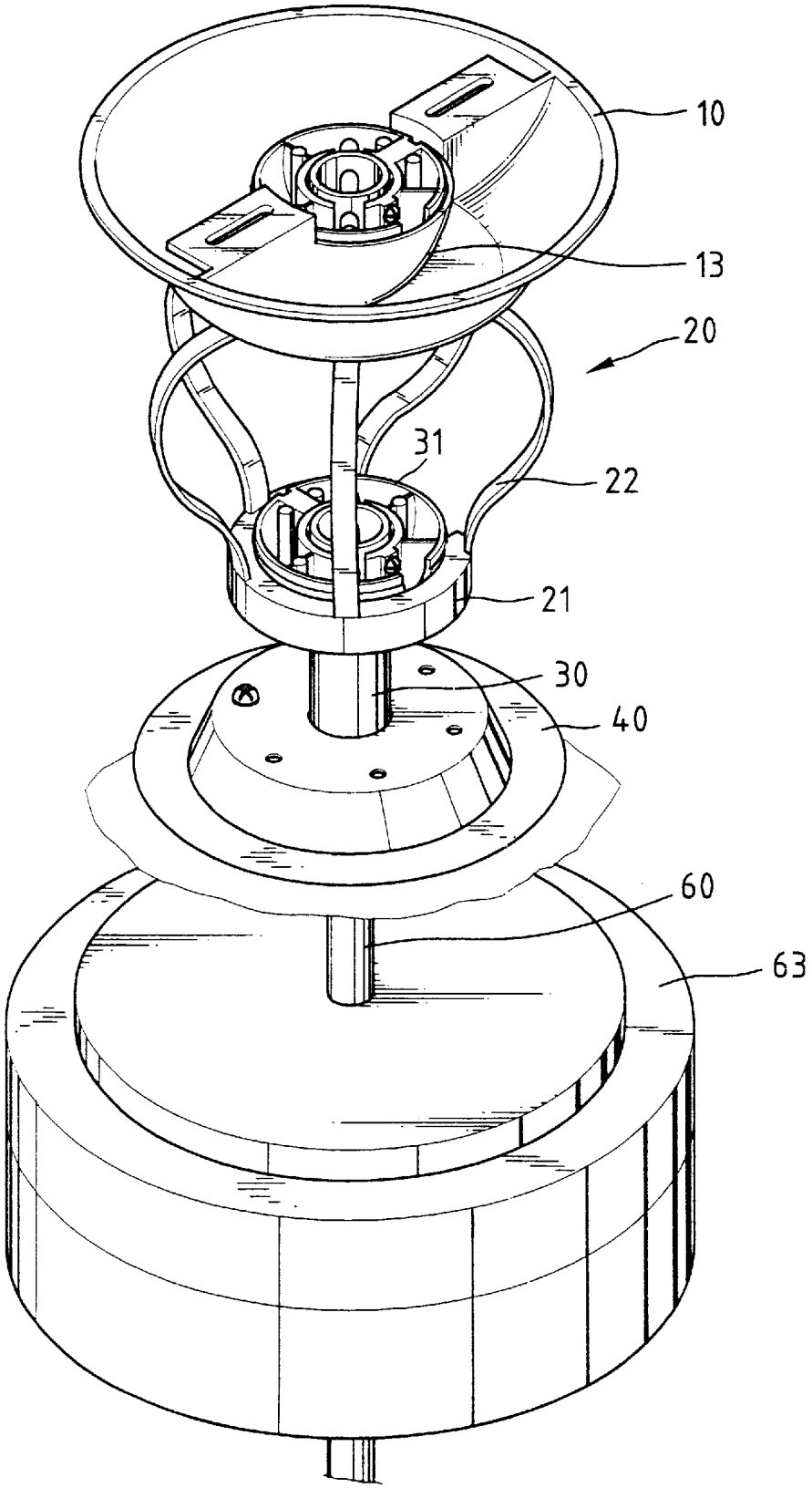
FIG. 1 is a perspective view of a first embodiment of a suspension assembly for ceiling fans in accordance with the present invention.
Figure 2:
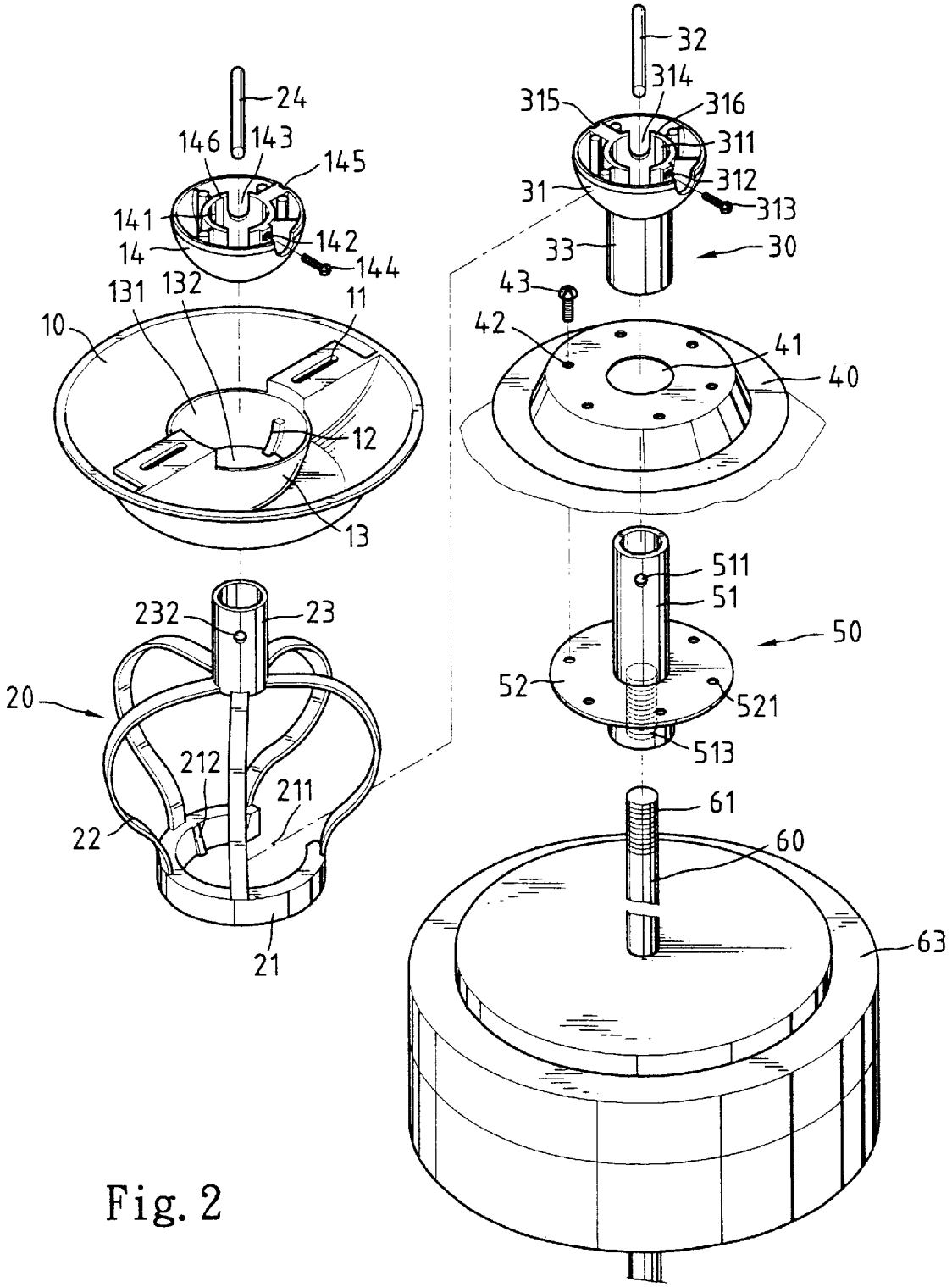
FIG. 2 is an exploded perspective view of the suspension assembly in FIG. 1.
Figure 3:
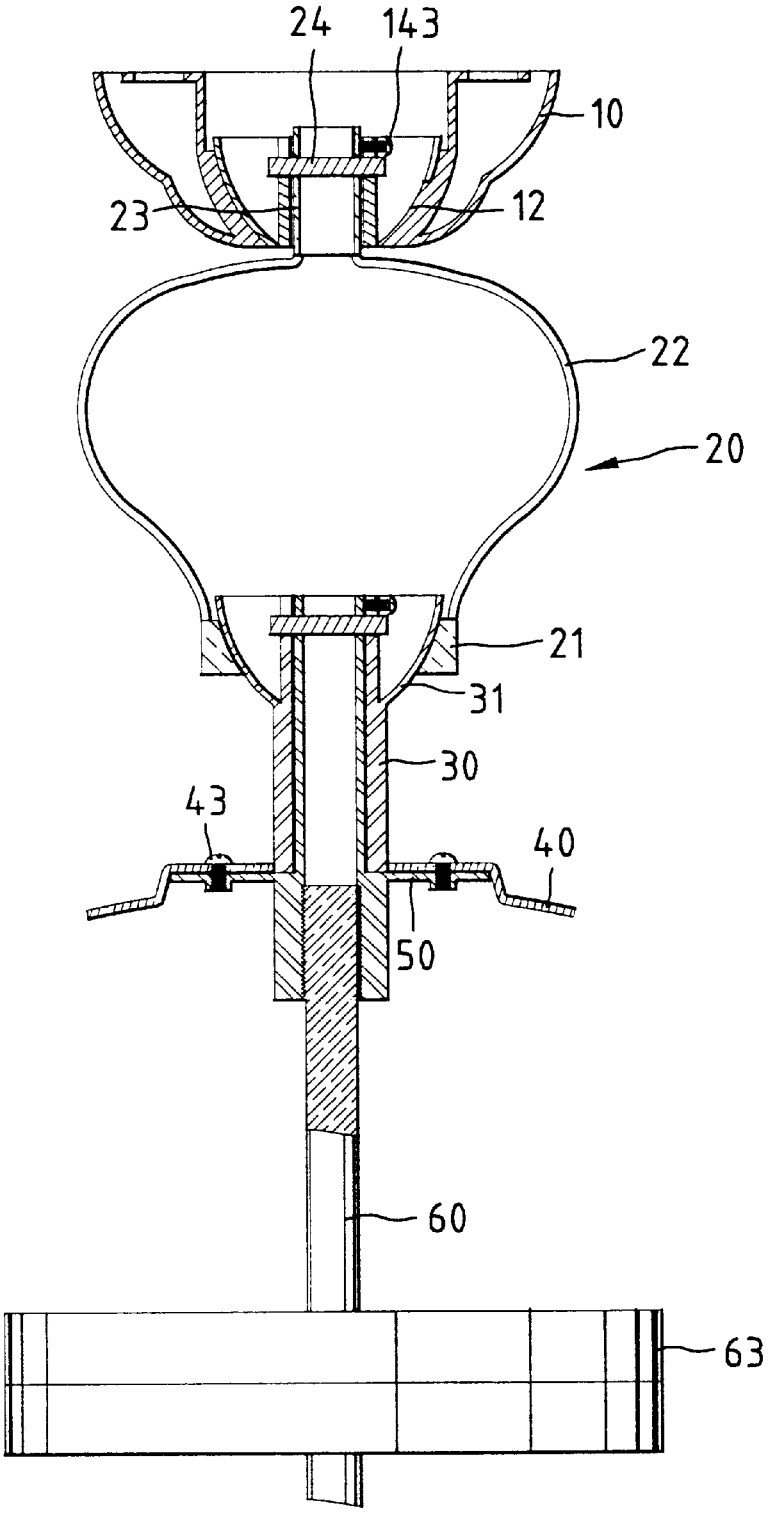
FIG. 3 is a sectional view of the suspension assembly in FIG. 1.

Referring to the drawings and initially to FIGS. 1 to 3, a suspension assembly for ceiling fans in accordance with the present invention generally includes an upper supporting member 10 securely attached to a ceiling (not shown), an upper connecting means 20, an upper suspension means 14, a lower suspension means 30, and a lower connecting means 50. The upper supporting member 10 includes a bowl-shaped retaining seat 13 having a spherical inner periphery 131 and a through hole 132 extending along a longitudinal axis thereof, as shown in FIG. 2. In addition, two slots 11 are defined in the upper supporting member 10 such that screws (not shown) may be extended through the slots 11 to secure the upper supporting member 10 to the ceiling. The upper suspension means 14 is bowl-shaped and includes a spherical outer periphery having a notch 145 defined therein so as to be fittingly, securely received in the bowl-shaped retaining seat 13 by means of engagement of the notch 145 and a protrusion 12 formed on the inner periphery 131 of the retaining seat 13. As shown in FIG. 2, the upper suspension means 14 further includes a frame wall 146 having a central through hole 141 defined therein, and a screw hole 142 is defined in an outer periphery of the frame wall 146. In addition, a transverse radial hole 143 is defined in the frame wall 146.

The upper connecting means 20 includes a C-shaped ring base 21 having a notch 211 defined therein and an upper connecting rod 23 formed above and supported by the ring base 21 by a supporting means 22, e.g., arcuate supporting pieces 22 integrally formed between the ring base 21 and the rod 23, best shown in FIG. 2. The upper connecting rod 23 includes a pin hole 232, which will be described later.

The lower suspension means 30 includes a bowl-shaped lower suspension member 31 and a lower suspension tube 33 extending downwardly from the bowl-shaped member 31. The bowl-shaped member 31 includes a spherical outer periphery having a notch 315 defined therein so as to be fittingly, securely receiving a protrusion 212 formed on a spherical inner periphery (FIG. 3) of the ring base 21. As shown in FIG. 2, the lower suspension member 30 further includes a frame wall 316 having a central through hole 311 defined therein, and a screw hole 312 is defined in an outer periphery of the frame wall 316. In addition, a transverse radial hole 314 is defined in the frame wall 316.

The lower connecting means 50 includes a tube 51 and a flange 52 formed around the tube 51 and having a number of holes 521 defined therein. A lower section of the tube 51 includes a screw hole 513 defined therein. A motor casing 40 is mounted to the disc 52 by means of extending screws 43 through holes 42 defined in the motor casing 40 and the holes 521. The motor casing 40 further includes a through hole 41 through which the tube 51 extends. In addition, as shown in FIGS. 2 and 3, a motor 63 is securely attached to the lower connecting means 50 by means of engagement between a threading 61 on a rod 60 (which, in turn, is securely attached to an upper side of the motor 630 and the screw hole 513. A fan assembly (not shown) is mounted below the motor 63 by means of any suitable conventional means.

In assembly, the upper suspension means 14 is placed into the retaining seat 13 of the upper supporting member 10 with the protrusion 12 received in the notch 145. Then, the upper connecting rod 23 is extended through the hole 141, and a pin 24 is extended through the transverse radial hole 143 and the hole 232 of the upper connecting rod 23 (FIG. 3) to fix the upper connecting means 20 in position. A screw 144 is inserted through the screw hole 142 and frictionally contacts with an outer surface of the upper connecting rod 23 to thereby provide an additional means for preventing disengagement of the upper connecting rod 23. Thus, a first shock-absorbing structure is formed.

Then, the lower suspension member 31 is inserted into an interior of the upper connecting means 20 via the notch 211 and with the protrusion 212 received in the notch 315. Thereafter, the motor casing 40 is attached to the disc 52 of the lower connecting means 50, while the tube 51 of the lower connecting means 50 is extended into the hole 311 of the lower suspension means 30. A pin 32 is extended through the transverse radial hole 314 and the hole 511, and a screw 313 is inserted through the screw hole 312 and frictionally engages with an outer surface of the tube 51. Finally, the motor 63 is secured to the lower connecting means 50 by means of engagement between threading 61 and the screw hole 513. By such an arrangement, the assembly procedure can be easily and quickly accomplished, and the suspension assembly so arranged may be applied to an oblique-ceiling and may effectively absorb shocks and vibrations of the fan blades.

Figure 4:
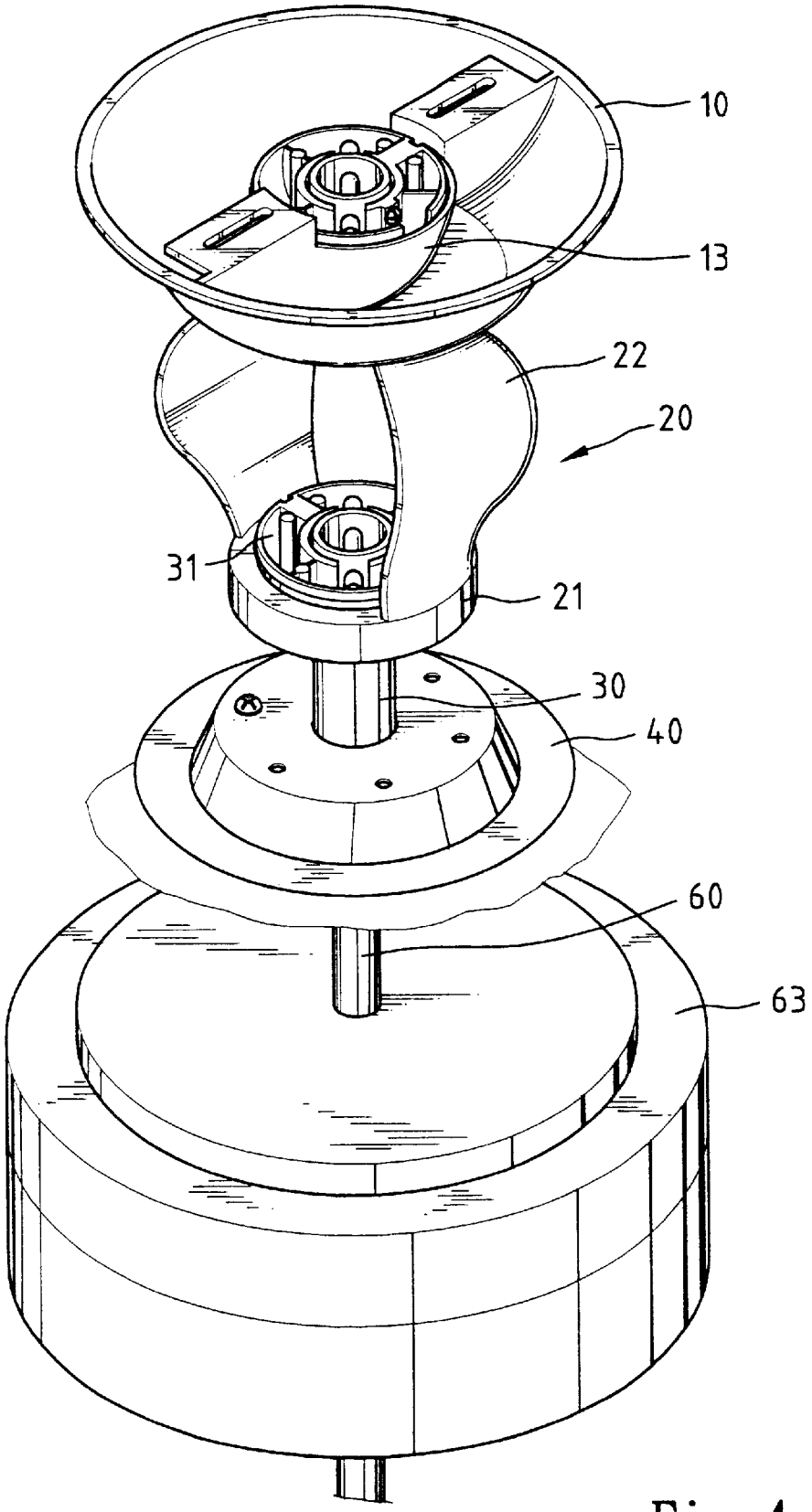
FIGS. 4 to 9 are modified embodiments of the suspension assembly in accordance with the present invention.
Figure 5:
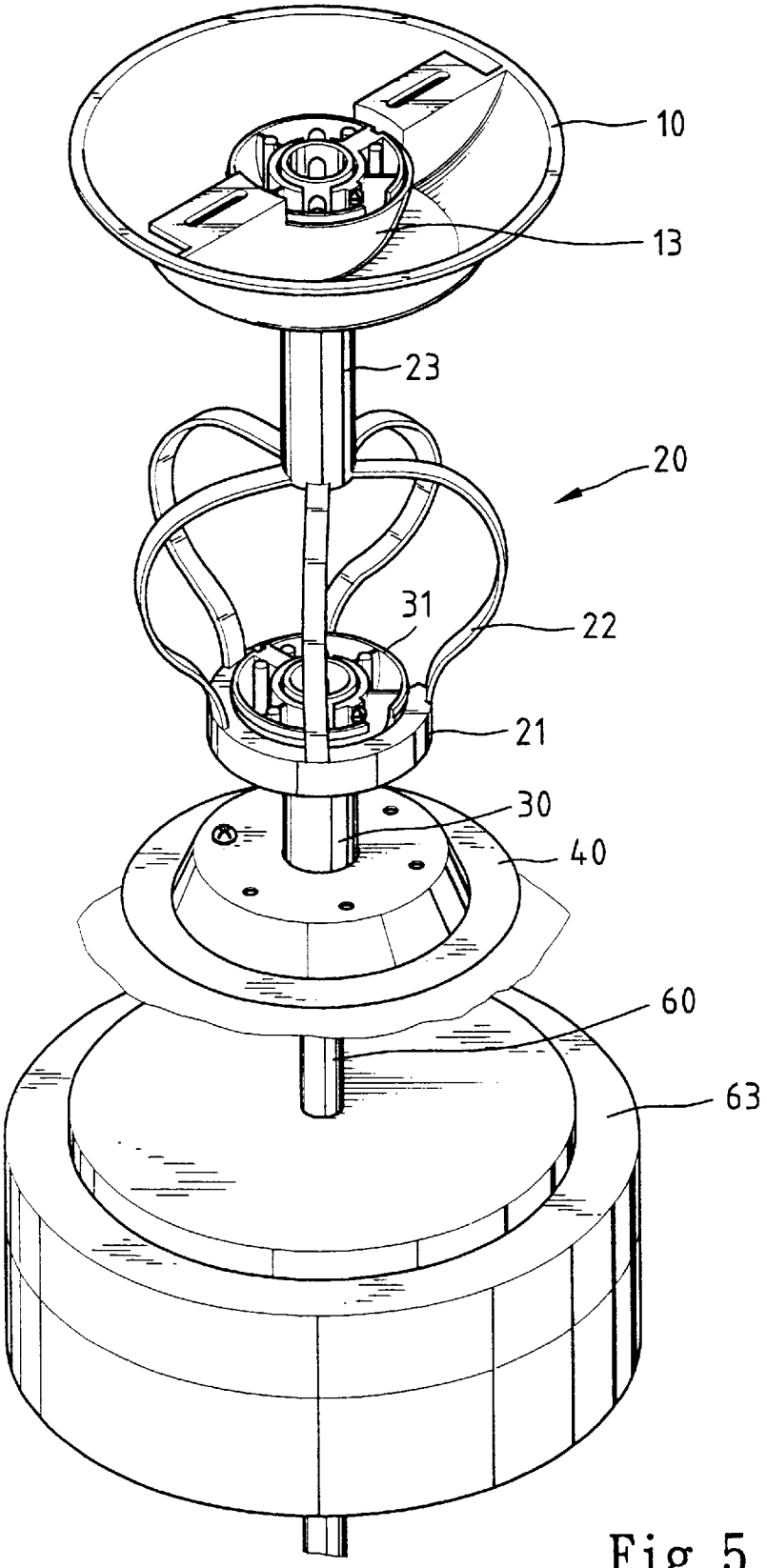
Figure 6:
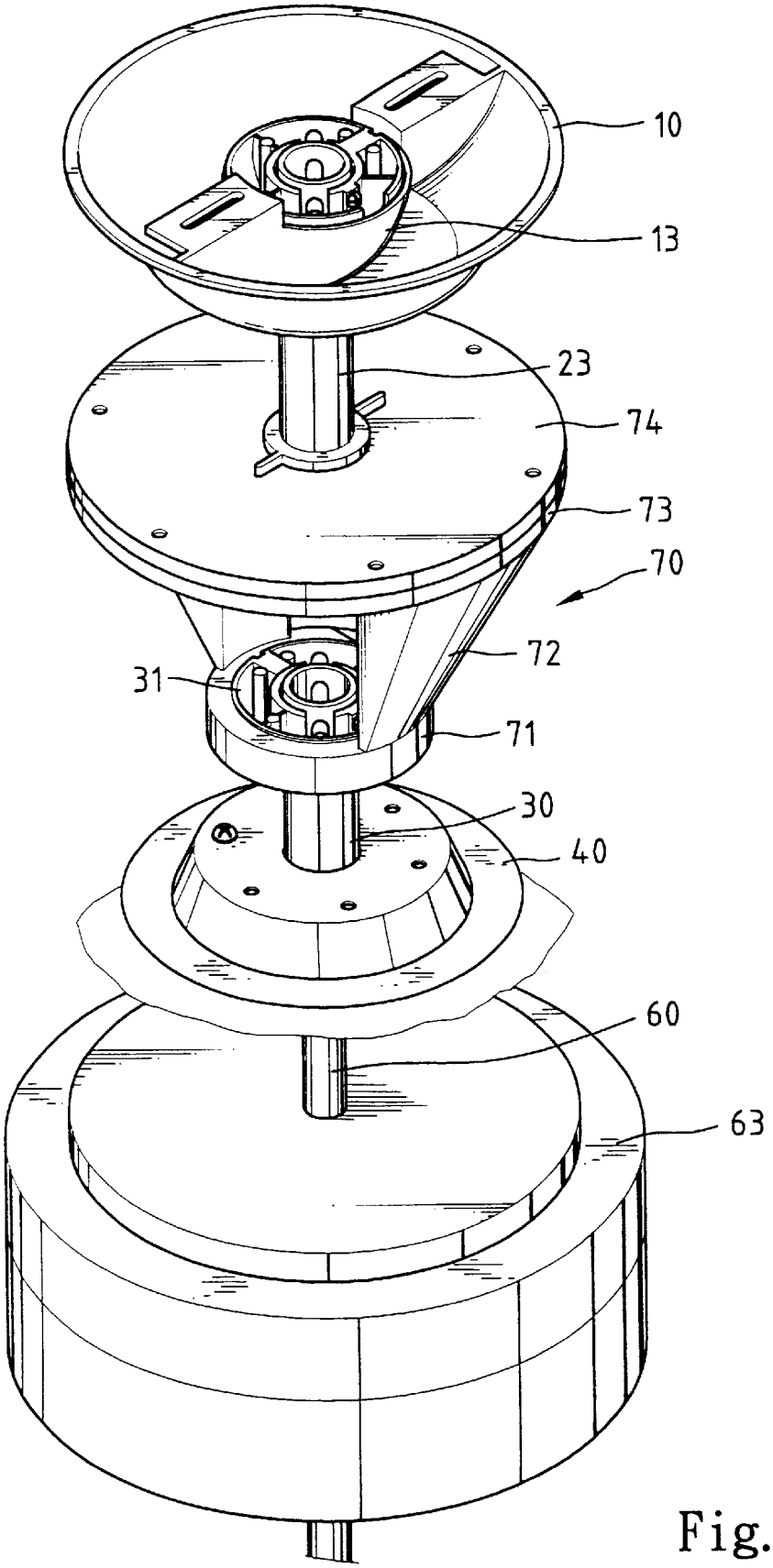
Figure 7:
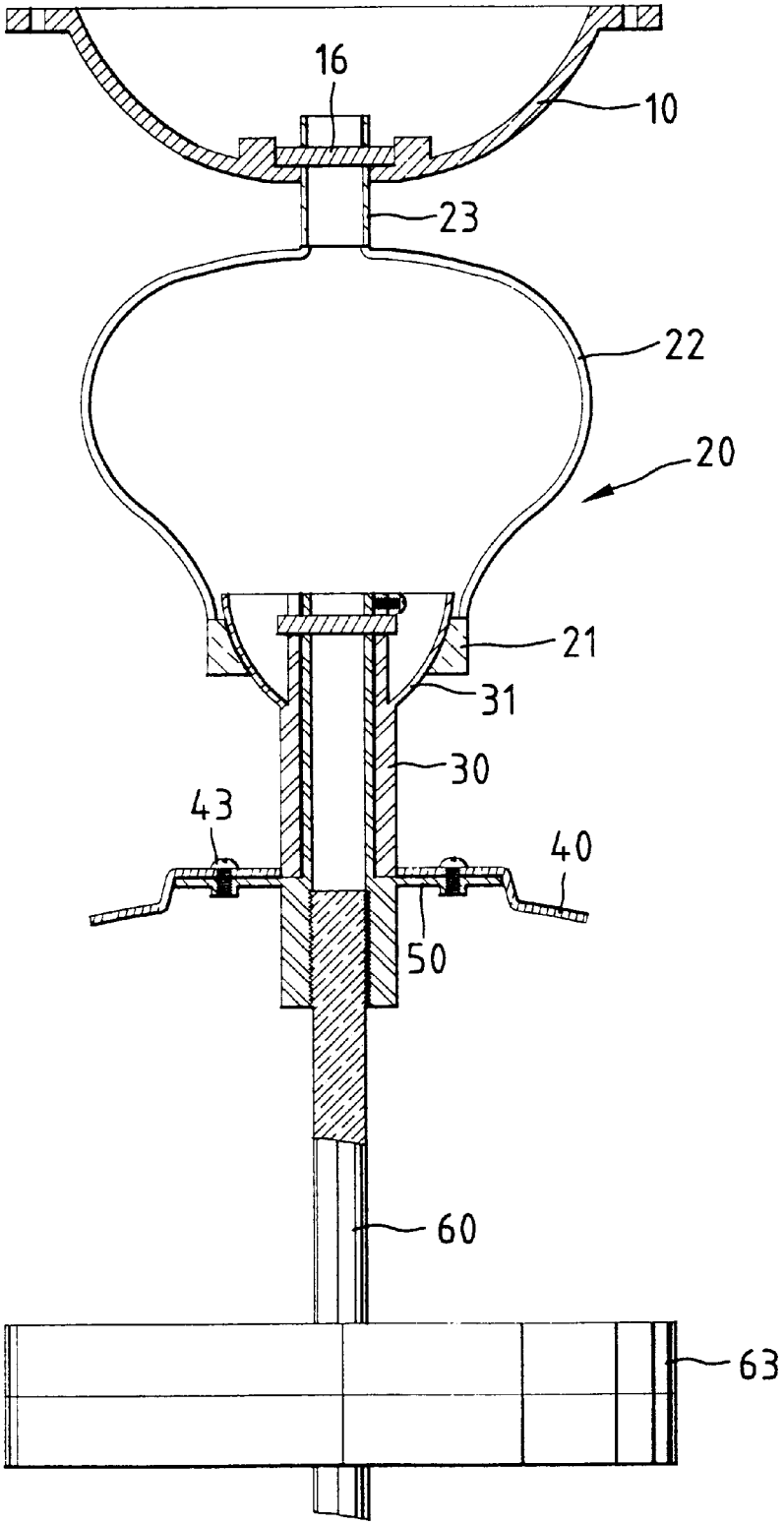

FIG. 4 is a modified embodiment of the suspension assembly in accordance with the present invention, wherein the arcuate supporting means 22 has an increased width. FIG. 5 is another modified embodiment, wherein the upper connecting rod 23 has an increased length so as to be applied to a ceiling at a higher level. FIG. 6 illustrates still another modified embodiment, wherein the upper connecting means 20 is replaced by another upper connecting means 70 which includes a ring base 71, an upper connecting face 73, a number of supporting members 72 formed between the upper connecting face 73 and the ring base 71, and an upper cover 74 mounted to the upper connecting face 73. This arrangement also can be applied to a ceiling at a higher level. FIG. 7 illustrates yet another modified embodiment, wherein engagement between the upper supporting member 10 and the upper suspension means 20 is achieved by a fixed pin 16 without adversely affecting the shock-absorbing function.

Figure 8:
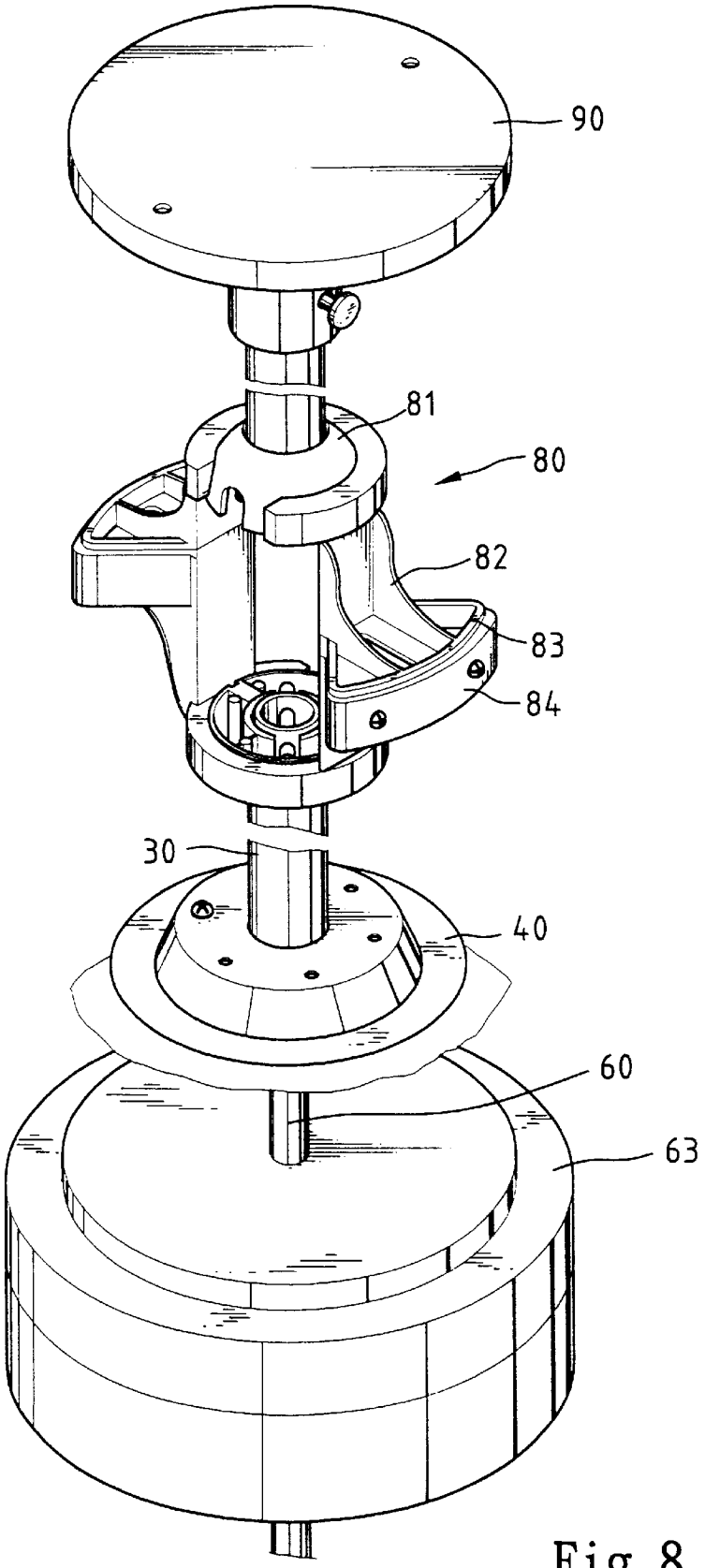
Figure 9:
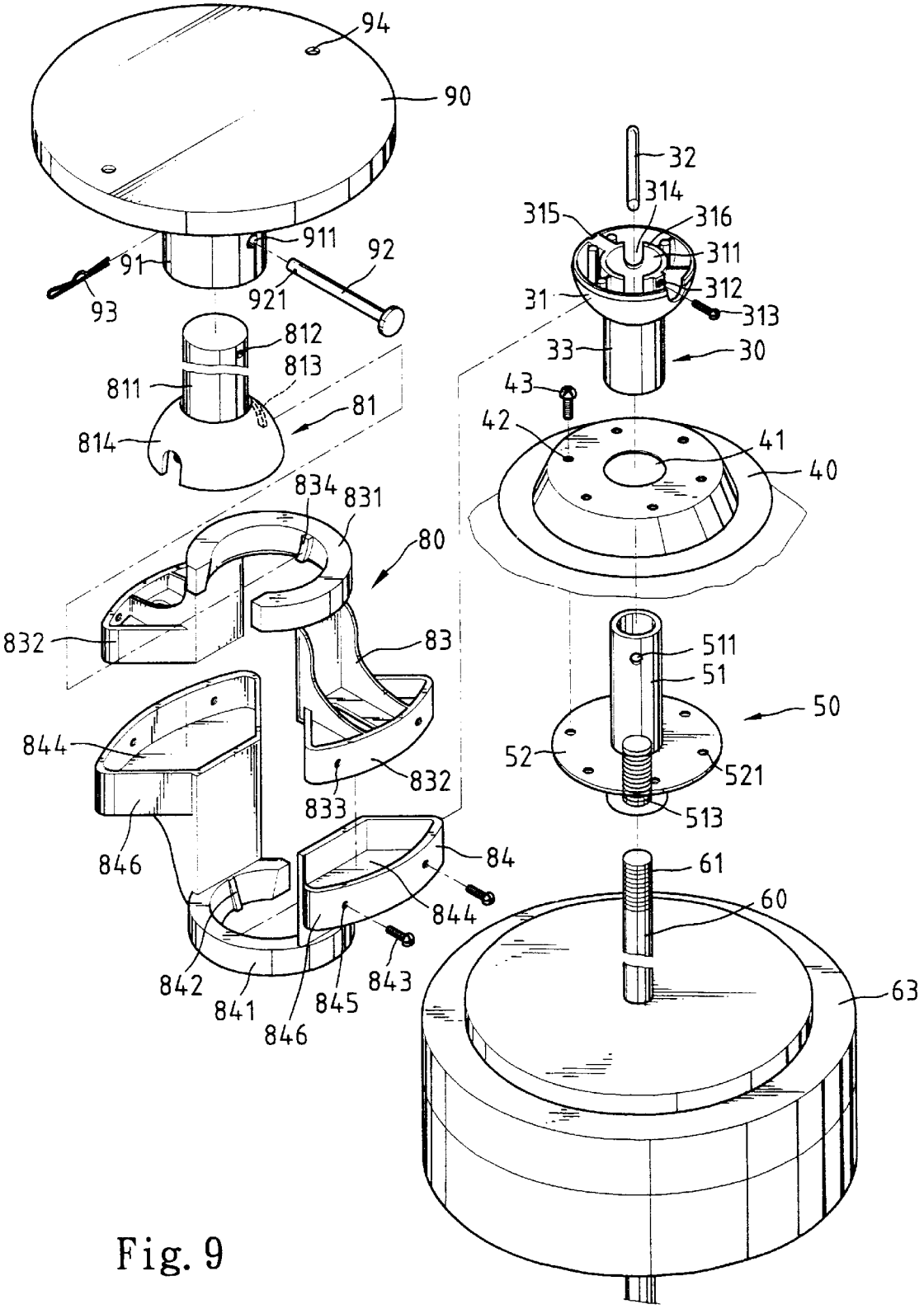

FIGS. 8 and 9 illustrate still another modified embodiment, wherein the upper supporting member 10 is replaced by another upper supporting member 90 (in the form of a flat disc) secured to the ceiling, and the upper connecting means 20 is replaced by another upper connecting means 80. The flat disc 90 includes screw holes 94 defined therein through which screws (not shown) may extend to secure the disc 90 to the ceiling. In addition, the disc 90 further includes a tube 91 extending downwardly from an underside thereof, which will be described later. An upper suspension means 81 includes an inverted bowl-shaped member 814 with a notch 813 defined in an outer periphery thereof and a rod 811 extending upwardly from the member 814 and may be extended into the tube 91. An axle 92 is extended through a pin hole 911 defined in the tube 91 and through a pin hole 812 defined in the member 814 to secure the upper suspension member 81 to the tube 91, and a pin 93 is extended through a pin hole 921 defined in the axle 92 to secure the axle 92 in position.

The upper connecting means 80 includes an upper suspension seat 83 and a lower suspension seat 84. The upper seat 83 includes a ring 831 having a protrusion 834 formed on an inner periphery thereof for engaging with the notch 813 of the member 81 and a pair of diametrically disposed substantially L-shaped wings 832 extending downwardly and outwardly from the ring 831. The lower seat 84 includes a C-shaped ring 841 having a protrusion 842 formed on an inner periphery for engaging with the notch 315 on the lower suspension means 30 and a pair of diametrically disposed substantially L-shaped wings 846 extending upwardly and outwardly for engaging with the wings 832. In this embodiment, each wing 846 includes a receiving compartment 844 defined in a horizontal section thereof for receiving a horizontal section of an associated wing 832 of the upper seat 83. Screws 843 are extended through screw holes 845 defined in the wings 846 and screw holes 833 defined in the wings 832 to secure the wings 846 and 832 together. Construction and assembly of the other members (including the lower suspension means 30, the motor casing 40, and the lower connecting means 50) are the same as those of the above embodiments.

According to the above description, it is appreciated that the present invention provides a suspension assembly for ceiling fans which has two supporting points which may effectively absorb the shocks and vibrations during rotation of the ceiling fan. The suspension assembly can be mounted to an oblique ceiling as the two bowl-shaped members may provide an adjustment in the vertical direction. Further, the suspension assembly can be assembled easily can quickly.

Although the invention has been explained in relation to its preferred embodiment, it is to be understood that many other possible modifications and variations can be made without departing from the spirit and scope of the invention as hereinafter claimed.

What is claimed is:

1. A suspension assembly for ceiling fans, comprising an upper suspension subassembly including an upper end adapted to be secured to a ceiling and a lower end, a connecting means comprising an upper end having a spherical surface engagement relationship with the lower end of the upper suspension subassembly and a lower end, and a lower suspension subassembly including an upper end having a spherical surface engagement relationship with the lower end of the connecting means and a lower end adapted to be securely attached to a motor for driving a ceiling fan further comprising:

an upper supporting member (10) adapted to be securely attached to a ceiling, the upper supporting member (10) including a first spherical surface portion, an upper suspension means (14) securely connected to the upper supporting member and having a second spherical surface portion for engaging with the first spherical surface portion, an upper connecting means (20; 70) having an upper end securely connected to the upper suspension means (14) and a lower end with a third spherical surface portion, a lower suspension means (30) including a lower suspension member (31) with a fourth spherical surface portion for securely engaging with the third spherical surface portion of the upper connecting means (20; 70) and a lower suspension tube (33) extending downwardly from the lower suspension member (31), and a lower connecting means (50) including an upper portion (51) extended through the lower suspension tube (33) and secured to the lower suspension member (31) and a lower portion (513) adapted to be securely attached to a motor (63) for driving a ceiling fan, wherein the upper supporting member (10) includes a bowl-shaped retaining seat (13) having a spherical inner periphery (131) defining the first spherical surface portion and a through hole (132) extending along a longitudinal axis thereof, and the upper suspension means (14) is bowl-shaped and includes a spherical outer surface defining the second spherical surface portion to be fittingly, securely received in the retaining seat (13), and wherein the spherical inner periphery (131) of the retaining seat (13) includes a protrusion (12) formed thereon, and the spherical outer surface of the upper suspension means (14) includes a notch (146) defined therein for securely receiving the protrusion (12), wherein the upper suspension means (14) further includes a frame wall (146) having a central through hole (141) defined therein and a transverse radial hole (143) defined therein, and the upper connecting means (20) includes a ring base (21), an upper connecting rod (23) and a supporting means (22) formed between the ring base (21) and the upper connecting rod (23), the upper connecting rod (23) includes a hole (232) defined therein and is partially received in the central through hole (141) of the frame wall (146), and further comprises a pin (24) extended through the transverse radial hole (143) and the hole (232) in the upper connecting rod (23).

2. The suspension assembly according to claim 1, wherein the frame wall (146) further includes a screw hole (142) defined in an outer periphery thereof, and a screw (144) is extended through the screw hole (142) to frictionally engage with an outer periphery of the upper connecting rod (23).

3. The suspension assembly according to claim 1, wherein the lower suspension member (31) further includes a frame wall (316) having a central through hole (311) defined therein and a transverse radial hole (314) defined therein, and the upper end (51) of the lower connecting means (50) includes a hole (511) defined therein and is received in the central through hole (311) of the frame wall (316), and further comprises a pin (32) extended through the transverse radial hole (314) and the hole (511) in the lower connecting means (50).

4. The suspension assembly according to claim 1, wherein the frame wall (316) further includes a screw hole (312) defined in an outer periphery thereof, and a screw (313) is extended through the screw hole (312) to frictionally engage with an outer periphery of the upper portion (51) of the lower connecting means (50).

5. The suspension assembly according to claim 1, wherein the ring base (21) of the upper connecting means (20) includes a spherical inner periphery defining the third spherical surface portion, a second protrusion (212) is formed on the spherical inner periphery of the ring base (21), and the lower suspension member (31) is bowl-shaped and includes a spherical outer periphery defining the fourth spherical surface portion, and a second notch (315) is defined in the spherical outer surface of the lower suspension member (31) for receiving the second protrusion (212).

6. The suspension assembly according to claim 1, wherein the upper connecting means (70) includes a ring base (71), an upper connecting face (73), a supporting means (72) formed between the upper connecting face (73) and the ring base (71), and an upper cover (74) mounted to the upper connecting face (73).

7. A suspension assembly for ceiling fans, comprising:

an upper supporting member (90) adapted to be securely attached to a ceiling, a tube (91) extending downwardly from the upper supporting member (90), an upper suspension means (81) including an inverted bowl-shaped member (814) having an outer spherical surface defining a first spherical surface portion and a rod (811) extending upwardly from the inverted bowl-shaped member (814) and secured to the tube (91), an upper connecting means (83, 84) including an upper suspension seat (83) and a lower suspension seat (84), the upper suspension seat (83) including a first ring (831) having an inner periphery defining a second spherical surface portion, the upper suspension seat (83) further including a pair of diametrically disposed L-shaped first wings (832) extending downwardly and outwardly from the first ring (831), each said first wing (832) having a horizontal section, and the lower suspension seat (84) including a second ring (841) having an inner periphery defining a third spherical surface portion and a pair of diametrically disposed L-shaped second wings (846) extending upwardly and outwardly from the second ring (841), each said second wing (846) having a horizontal section with a receiving compartment (844) defined therein for securely receiving the horizontal section of an associated said first wing (832), a lower suspension means (30) including a lower suspension member (31) with a fourth spherical surface portion for securely engaging with the third spherical surface portion and a lower suspension tube (33) extending downwardly from the lower suspension member (31), and a lower connecting means (50) including an upper portion (51) extended through the lower suspension tube (33) and secured to the lower suspension member (31) and a lower portion (513) adapted to be securely attached to a motor (63) for driving a ceiling fan.

8. The suspension assembly according to claim 7, wherein the second ring (841) of the lower suspension seat (84) includes a protrusion (842) formed on an inner periphery thereof, and the fourth spherical surface portion of the lower suspension member (31) includes a notch (315) defined therein for securely receiving the protrusion (842).

9. The suspension assembly according to claim 7, wherein the lower suspension member (31) further includes a frame wall (316) having a central through hole (311) defined therein and a transverse radial hole (314) defined therein, and the upper end (51) of the lower connecting means (50) includes a hole (511) defined therein and is received in the central through hole (311) of the frame wall (316), and further comprises a pin (32) extended through the transverse radial hole (314) and the hole (511) in the lower connecting means (50).

10. The suspension assembly according to claim 9, wherein the frame wall (316) further includes a screw hole (312) defined in an outer periphery thereof, and a screw (313) is extended through the screw hole (312) to frictionally engage with an outer periphery of the upper portion (51) of the lower connecting means (50).

11. The suspension assembly according to claim 7, wherein the inverted bowl-shaped member (814) includes a notch (813) defined in an outer periphery thereof, and a protrusion (834) is formed on the inner periphery of the first ring (831) for engaging with the notch (813) of the inverted bowl-shaped member (814).

12. The suspension assembly according to claim 7, further comprising a motor casing (40) mounted around the lower connecting means (50) and the motor (63).

* * * * *